US008997310B2

(12) United States Patent
Davidshofer et al.

(10) Patent No.: US 8,997,310 B2
(45) Date of Patent: Apr. 7, 2015

(54) VACUUM CLEANER CYCLONE WITH HELICAL CYCLONE EXPANSION REGION

(71) Applicant: Electrolux Home Care Products, Inc., Charlotte, NC (US)

(72) Inventors: Donald Joseph Davidshofer, Mt. Holly, NC (US); Gregory James Kowalski, Cornelius, NC (US); John Curtis Morphey, Concord, NC (US)

(73) Assignee: Electrolux Home Care Products, Inc., Charlotte, NC (US)

( * ) Notice: Subject to any disclaimer, the term of this patent is extended or adjusted under 35 U.S.C. 154(b) by 196 days.

(21) Appl. No.: 13/650,662

(22) Filed: Oct. 12, 2012

(65) Prior Publication Data

US 2014/0101889 A1 Apr. 17, 2014

(51) Int. Cl.
*A47L 9/16* (2006.01)

(52) U.S. Cl.
CPC ..... *A47L 9/16* (2013.01); *A47L 9/1608* (2013.01); *A47L 9/1666* (2013.01)

(58) Field of Classification Search
USPC ..... 15/347, 352, 353, 327.1, 327.2; 55/337, 55/345, 429, 432, 459.1, 459.2
See application file for complete search history.

(56) References Cited

U.S. PATENT DOCUMENTS

| | | | |
|---|---|---|---|
| 471,272 | A | 3/1892 | Morse |
| 1,508,315 | A | 9/1924 | Brockway |
| 1,565,318 | A | 12/1925 | Fisher |
| 2,010,128 | A | 8/1935 | Arnold |
| 2,378,600 | A | 6/1945 | Tongeren |
| 2,432,757 | A | 12/1947 | Weniger |
| 2,542,634 | A | 2/1951 | Davis et al. |
| 2,698,672 | A | 1/1955 | Burnside et al. |
| 3,174,264 | A | 3/1965 | McKnab |
| 3,234,713 | A | 2/1966 | Harper et al. |
| 3,320,727 | A | 5/1967 | Farley et al. |
| 3,399,770 | A | 9/1968 | Salmon |
| 3,543,325 | A | 12/1970 | Hamrick |
| 3,745,965 | A | 7/1973 | Ljung et al. |
| 3,887,456 | A | 6/1975 | Loughner |
| 3,971,718 | A | 7/1976 | Reid |
| 4,059,419 | A | 11/1977 | Ross |

(Continued)

FOREIGN PATENT DOCUMENTS

| | | |
|---|---|---|
| GB | 2453862 | 4/2009 |
| GB | 2496509 | 5/2013 |

OTHER PUBLICATIONS

Combined Search and Examination Report for Application No. GB1306708.7 dated Aug. 20, 2013.

*Primary Examiner* — Dung Van Nguyen
(74) *Attorney, Agent, or Firm* — RatnerPrestia

(57) ABSTRACT

A vacuum cleaner dirt collection assembly having a housing, an air inlet and air outlet connected to the housing and a cyclone chamber inside the housing. The cyclone chamber has top and bottom walls, and an outer wall joining the top and bottom walls to form a generally enclosed space. The outer wall has a helical guide channel extending radially outward from the adjacent portion of the outer wall. An inner wall, located inside the enclosed space, has a generally cylindrical or frustroconical surface having one or more openings fluidly connecting the enclosed space to the air outlet. A separator plate is located inside the enclosed space at a location between the top and bottom walls. The separator plate extends towards the outer wall and is spaced from the outer wall by a gap.

19 Claims, 7 Drawing Sheets

(56) References Cited

U.S. PATENT DOCUMENTS

| | | | | |
|---|---|---|---|---|
| 4,062,766 | A | 12/1977 | Duesling | |
| 4,510,056 | A | 4/1985 | Fryhult et al. | |
| 4,537,314 | A | 8/1985 | Skardal | |
| 4,853,008 | A | 8/1989 | Dyson | |
| 4,953,253 | A | 9/1990 | Fukuda et al. | |
| 5,078,761 | A | 1/1992 | Dyson | |
| 5,137,554 | A | 8/1992 | Carter, Jr. | |
| 5,145,499 | A | 9/1992 | Dyson | |
| 5,224,976 | A | 7/1993 | Oranje | |
| 5,281,591 | A | 1/1994 | Burke | |
| 5,653,347 | A | 8/1997 | Larsson | |
| 5,846,273 | A | 12/1998 | Dyson | |
| D407,875 | S | 4/1999 | Burchard et al. | |
| 5,893,936 | A | 4/1999 | Dyson | |
| 6,129,775 | A | 10/2000 | Conrad et al. | |
| 6,146,434 | A | 11/2000 | Scalfani et al. | |
| 6,168,641 | B1 | 1/2001 | Tuvin et al. | |
| 6,168,716 | B1 | 1/2001 | Conrad et al. | |
| 6,312,594 | B1 | 11/2001 | Conrad et al. | |
| 6,363,574 | B2 | 4/2002 | Worden et al. | |
| 6,502,277 | B1 | 1/2003 | Petersson et al. | |
| 6,558,453 | B2 | 5/2003 | Sepke et al. | |
| D494,718 | S | 8/2004 | Rosenzweig et al. | |
| D494,719 | S | 8/2004 | Rosenzweig et al. | |
| 6,829,804 | B2 | 12/2004 | Sepke | |
| 6,910,245 | B2 | 6/2005 | Hawkins et al. | |
| D518,612 | S | 4/2006 | Parr et al. | |
| D520,692 | S | 5/2006 | Leyden | |
| 7,128,770 | B2 * | 10/2006 | Oh et al. | 55/343 |
| 7,163,568 | B2 | 1/2007 | Sepke et al. | |
| 7,222,392 | B2 | 5/2007 | McCormic et al. | |
| 7,228,592 | B2 | 6/2007 | Hawkins et al. | |
| D547,507 | S | 7/2007 | Medema et al. | |
| 7,247,181 | B2 * | 7/2007 | Hansen et al. | 55/337 |
| 7,293,326 | B2 | 11/2007 | Hawkins et al. | |
| 7,305,735 | B2 | 12/2007 | Overvaag | |
| D581,612 | S | 11/2008 | Yoo et al. | |
| D583,117 | S | 12/2008 | Peace et al. | |
| D587,415 | S | 2/2009 | Dyson et al. | |
| D589,219 | S | 3/2009 | Knox et al. | |
| 7,497,899 | B2 * | 3/2009 | Han et al. | 96/95 |
| 7,559,963 | B2 * | 7/2009 | Oh et al. | 55/337 |
| 7,594,945 | B2 | 9/2009 | Kim et al. | |
| 7,632,324 | B2 * | 12/2009 | Makarov et al. | 55/337 |
| D609,416 | S | 2/2010 | Hill et al. | |
| D609,418 | S | 2/2010 | Santiago et al. | |
| 7,662,200 | B2 | 2/2010 | Knuth et al. | |
| 7,682,414 | B2 | 3/2010 | Yoshida et al. | |
| 7,722,709 | B2 | 5/2010 | Conrad | |
| 7,771,499 | B2 | 8/2010 | Oh et al. | |
| 7,814,612 | B2 | 10/2010 | Sepke et al. | |
| D632,037 | S | 2/2011 | Carr et al. | |
| 7,879,142 | B2 | 2/2011 | Han et al. | |
| 7,922,794 | B2 | 4/2011 | Morphey | |
| 7,931,740 | B2 | 4/2011 | Al-Alusi et al. | |
| 7,951,214 | B2 | 5/2011 | Menrik et al. | |
| 8,225,456 | B2 | 7/2012 | Håkan et al. | |
| D670,052 | S | 10/2012 | Dos Reis | |
| 2002/0144637 | A1 | 10/2002 | Wendling et al. | |
| 2007/0012003 | A1 | 1/2007 | Oh et al. | |
| 2008/0184681 | A1 | 8/2008 | Oh et al. | |
| 2013/0219654 | A1 * | 8/2013 | Ruben | 15/347 |

* cited by examiner

VACUUM CLEANER CYCLONE WITH HELICAL CYCLONE EXPANSION REGION

BACKGROUND OF THE INVENTION

1. Field of the Invention

The present invention relates to features for use with vacuum cleaners having a centrifugal or cyclonic air separation system. More specifically, the present invention relates to a cyclone having a feature such as a helical cyclone expansion region formed on the inner surface of the outer cyclone wall.

2. Description of the Related Art

Referring to FIG. 1, a typical upright vacuum cleaner 100 includes a base 102 that is configured to move along a surface such as a floor, and an upper housing 104 that usually is pivotally mounted to the base 102 and provided with a grip 106 that is used to manipulate and maneuver the device. The downward-facing surface of the base 102 includes a main suction inlet that faces the floor, and through which dirt-laden air is drawn into the device by a motor-driven vacuum fan 108. The vacuum fan 108 may be located in the upper housing 104, as shown, or in the base 102. The main inlet and vacuum fan 108 are in fluid communication by one or more ducts and flexible hoses (not shown) that collectively form a flow path through the vacuum cleaner 100. Ultimately, the air exits the flow path through an outlet to the ambient air. Any number of filtration devices, such as screens, pleated filters, foam filters, and cyclonic separators may be included in the flow path, either upstream or downstream of the vacuum fan 108. Examples of upright vacuum cleaners having these and other features are provided in U.S. Pat. Nos. 7,814,612; 7,163,568; 7,293,326; 7,228,592; 6,829,804 and 7,662,200, which are incorporated herein by reference. For example, the upright vacuum cleaner 100 may have a cyclone chamber 110 located in the upper housing 104. The cyclone chamber 110 or other separation device may alternatively be located in the base 102.

A typical canister vacuum cleaner 200 has a canister body 202 that is connected to a cleaning head 204 by a flexible hose 206 and rigid pipe 208. The pipe 208 often has a grip 210 for manipulating the cleaning head 204. The lower surface of the cleaning head 204 has a suction inlet that is fluidly connected, through the pipe 208 and hose 206, to a vacuum fan (not shown) located inside the canister body 202. As with an upright vacuum cleaner, the canister vacuum cleaner 200 has a flow path in which one or more filtration devices 212 are located. The filtration device 212 usually is in the canister body 202. It is also known to add auxiliary filtration devices, such as a small cyclone separator, to the pipe 208 or cleaning head 204. Examples of canister vacuum cleaners include U.S. Pat. Nos. 3,745,965; 4,953,253; 6,168,641; 6,502,277 and 7,951,214, which are incorporated herein by reference.

Another common variation of a vacuum cleaner is a handheld vacuum cleaner, such as the one shown in U.S. Patent. Publication No. 2007/0271724, which is incorporated herein by reference. Such devices usually comprise a lightweight housing configured for handheld use. Cyclonic separators and other inertial separators are often used in such devices, and it also is common to use a simple filter or bag filter arrangement.

A number of variations of upright and canister vacuum cleaners are known in the art. For example, central vacuum cleaners include a canister that is permanently mounted in a dwelling, and a portable cleaning head that is fluidly connected to the canister by suction tubes distributed throughout the house. Canister vacuums are also often operated as backpack systems with the canister body mounted on the operator's back. Also, upright vacuum cleaners are often scaled down and lightened to form a so-called "stick" vacuum. In some cases, the suction motor and dirt collector may be provided as a handheld or canister unit that can be removed and used separately from an upright, stick, or canister vacuum cleaner.

Cyclonic separation systems of various types have been used in vacuum cleaners. Typically, a cyclonic vacuum uses a rigid cyclone container in place of a bag. The cyclone container typically is cylindrical or somewhat tapered, and includes an inlet that receives dirty air, and an outlet through which cleaned or partially-cleaned air exits. A vacuum fan is used to convey the air through the cyclone container, and the fan may be located upstream or downstream of the cyclone container. As the air passes through the cyclone container, it is directed in a cyclonic pattern to remove dirt and dust from the air flow due to the vortex motion of the cyclone. The removed dirt and dust is deposited in the lower portion of the container or directed into an auxiliary dirt collection container as it drops out of the cyclonic air flow. Auxiliary collection chambers are often mounted to the bottom of the cyclone, but it is also known to place the container to the side. Collection chambers may be located essentially anywhere to receive the dirt being centrifuged out of the airstream.

The air inlet is often provided at an angle relative to the rotational axis of the airflow within the cyclone container to help initiate the cyclonic flow. In some cases, however, the inlet is perpendicular to the axis, in which case a vane or other structure may be located at or near the inlet to initiate cyclonic flow. The air outlet can take any number of forms, such as a simple tube that extends into the cyclone chamber and is open at the end and/or sides.

It is also well known to use more than one cyclone in the air flow path, and multiple series and/or parallel cyclones may be used in a single vacuum cleaner.

Further, filtration features, such as perforated shrouds and other kinds of filter, may be used within the air flow path, either within the cyclone or cyclones, or upstream or downstream of them. For example, a shroud may be used to help direct the air flow within the cylindrical container into a vortex, and to force the airflow to change directions to remove particles by inertia. Shrouds may come in various shapes and sizes, and it is known to provide cylindrical shrouds, conical shrouds, frustroconical shrouds, and shrouds having other shapes. Shrouds may be formed with a mesh type screen, circular perforations, or other apertures or openings to allow air to pass through the shroud while filtering out larger particles. Depending on the application, the perforations may be specifically sized to prevent certain size dust and dirt particles from passing through, while providing relatively little impediment to the airflow.

It is also well known that cyclone shrouds may be provided in the form of microporous filters. Filters used in cyclones may comprise any of various useful types and shapes, such as pleated, foam, ultra-fine, HEPA, ULPA, and so on. Combinations of shrouds and/or microporous filters having various filtration sizes may be used in any number of combinations within or in conjunction with a vacuum cleaner cyclone separator. For example, a perforated shroud or mesh screen may surround a pleated or foam filter to provide plural filtration stages, or a shroud may be formed as two or more stacked filters.

Cyclone shrouds and other kinds of filter also may have other features to enhance airflow or dirt separation. For example, a feature such as a flow reversing lip may be added to a shroud. Flow reversing lips typically are located circumferentially around the bottom lip of the shroud and extend downward, at an angle, or radially, to obstruct the airflow flowing from below the shroud up to the shroud surface. Such flow reversing lips may enhance dirt separation, prevent larger objects from being lifted into contact with the shroud's perforated surface, or provide other benefits. Flow reversing lips are also known as separator plates. Exemplary cyclonic vacuums having shrouds, reversing lips/separator plates, filters, and other filtration and flow controlling devices are described in U.S. Pat. Nos. 5,145,499; 5,893,936; 6,910,245; and 7,222,392, which references are incorporated herein.

It is also known to include airflow modifying features within the cyclone chamber, such as features that disrupt the cyclonic flow pattern to prevent re-entrainment of the dirt (often provided at the bottom of the lower housing where dirt collects). For example, U.S. Pat. No. 7,163,568 shows a stepped cyclone floor that disrupts airflow to separate particles, and U.S. Pat. No. 2,432,757 shows ribs located on the inner and outer walls of a conventional cyclone separator to modify the airflow in the chamber. Other devices include ramp-like ribs that protrude radially into the airflow path; U.S. Pat. No. 3,234,713 shows one such arrangement. It has also been speculated that cyclones having irregular shapes and side chambers of various shapes and sizes, such as those shown in U.S. Pat. No. 6,168,716, can generate multiple cyclones located outside a central cyclone. The foregoing references are incorporated herein by reference.

While various prior art devices like the ones described above have been used in the art, there still exists a need to provide alternatives to such devices.

SUMMARY

In one exemplary embodiment, there is provided a vacuum cleaner dirt collection assembly having a housing, an air inlet connected to the housing, an air outlet connected to the housing, and a cyclone chamber inside the housing and fluidly connected between the air inlet and the air outlet. The cyclone chamber may include a top wall, a bottom wall, and an outer wall extending between and joining the top wall and bottom wall to form a generally enclosed space having a central axis extending from the top wall to the bottom wall. The outer wall has a helical guide channel extending radially outward, with respect to the axial centerline, from an adjacent portion of the outer wall. An inner wall is located inside the generally enclosed space. The inner wall may have a generally cylindrical or frustroconical surface having one or more openings fluidly connecting the generally enclosed space to the air outlet. A separator plate may be located inside the generally enclosed space at a location along the central axis between the top wall and the bottom wall. The separator plate may extend towards the outer wall and may be spaced from the outer wall by a gap.

The recitation of this summary of the invention is not intended to limit the claims of this or any related or unrelated application. Other aspects, embodiments, modifications to and features of the claimed invention will be apparent to persons of ordinary skill in view of the disclosures herein.

BRIEF DESCRIPTION OF THE DRAWINGS

A better understanding of the exemplary embodiments may be understood by reference to the attached drawings, in which like reference numbers designate like parts. The drawings are exemplary and not intended to limit the claims in any way.

DETAILED DESCRIPTION

Figure 1:
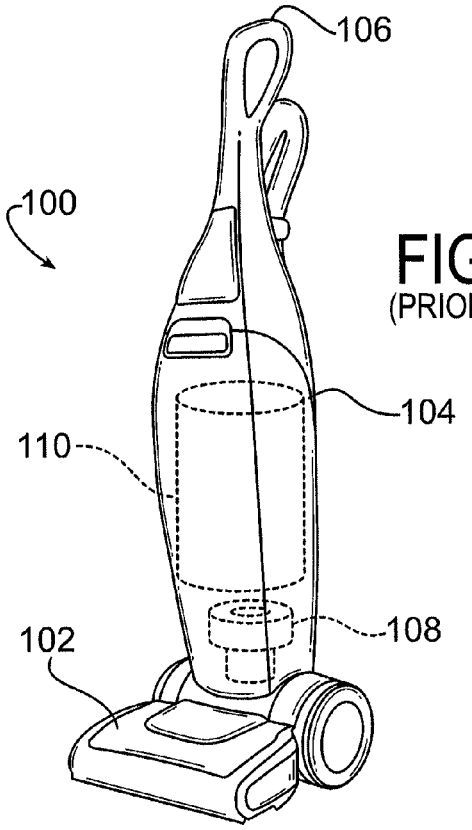
FIG. 1 (PRIOR ART)
FIG. 1 is an exemplary prior art upright vacuum cleaner that may be used in conjunction with embodiments of the present invention.
Figure 2:
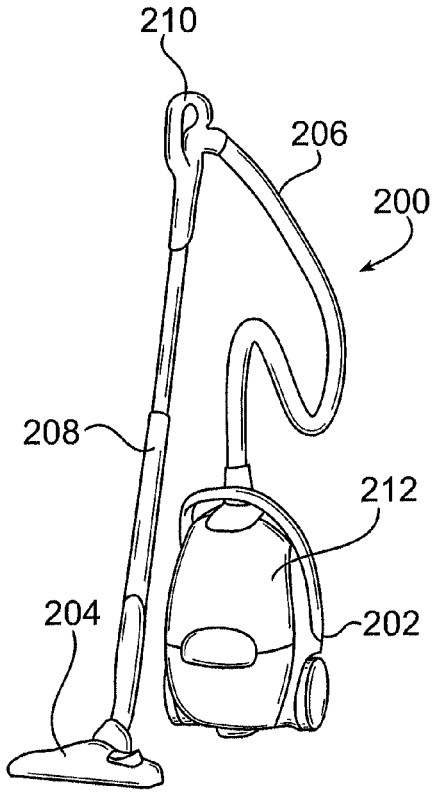
FIG. 2 (PRIOR ART)
FIG. 2 is an exemplary prior art canister vacuum cleaner that may be used in conjunction with embodiments of the present invention.

The exemplary embodiments described herein relate to cyclone separators for use in commercial and household vacuum cleaners. Examples of prior art vacuum cleaners are shown in FIGS. 1 and 2, which show an upright vacuum cleaner 100 and a canister vacuum cleaner 200, respectively. Other embodiments may be used with central, backpack, stick and other kinds of vacuum cleaner, such as those described previously herein.

Referring now to FIGS. 3-6, an exemplary embodiment of a dirt collection assembly 300 is shown in front and partially cutaway front views, respectively. The dirt collection assembly 300 may be adapted for use in an upright, canister, central or any other type of vacuum cleaner. The dirt collection assembly 300 may be constructed such that it can be removable as a contained unit from a vacuum cleaner. It will also be appreciated that all or portion of the dirt collection assembly may be permanently attached to the remainder of the vacuum cleaner in other embodiments. For example, the shroud and lower housing (described below) may be the only parts that can be removed from the rest of the cleaner.

The dirt collection assembly 300 has at least one air inlet 302 and at least one air outlet 304, and preferably forms a generally air-tight container other than the inlet and outlet. The air inlet 302 is fluidly connected downstream of a suction inlet (e.g., a floor nozzle, accessory hose, or cleaning tool) to receive dirt-laden air. The air outlet 304 is downstream of the air inlet 302, and permits the egress of air that has been at least partially cleaned by the dirt collection assembly 300. A vacuum fan (see, e.g., FIG. 1) is provided to move air through the dirt collection assembly 300. The vacuum fan may be upstream or downstream of the dirt collection assembly 300, and may be contained in a separate part of the vacuum cleaner or within the dirt collection assembly 300 itself.

The dirt collection assembly 300 includes a cyclone separator, and may include one or more filters located within or downstream of the cyclone separation stage. For example, a foam filter 502 (FIG. 5) or pleated filter may be provided downstream of the cyclone separator and immediately upstream of the outlet 304. Other kinds of separator, such as bags and electrostatic filters, also may be added to the system. The cyclone separator may include a single-stage cyclone separator system, or a multiple-stage cyclone separator system having one or more additional cyclones located downstream of the first cyclone stage. The first stage and other stages may be operated in parallel with any number of other cyclone or non-cyclone separator stages.

Figure 3:
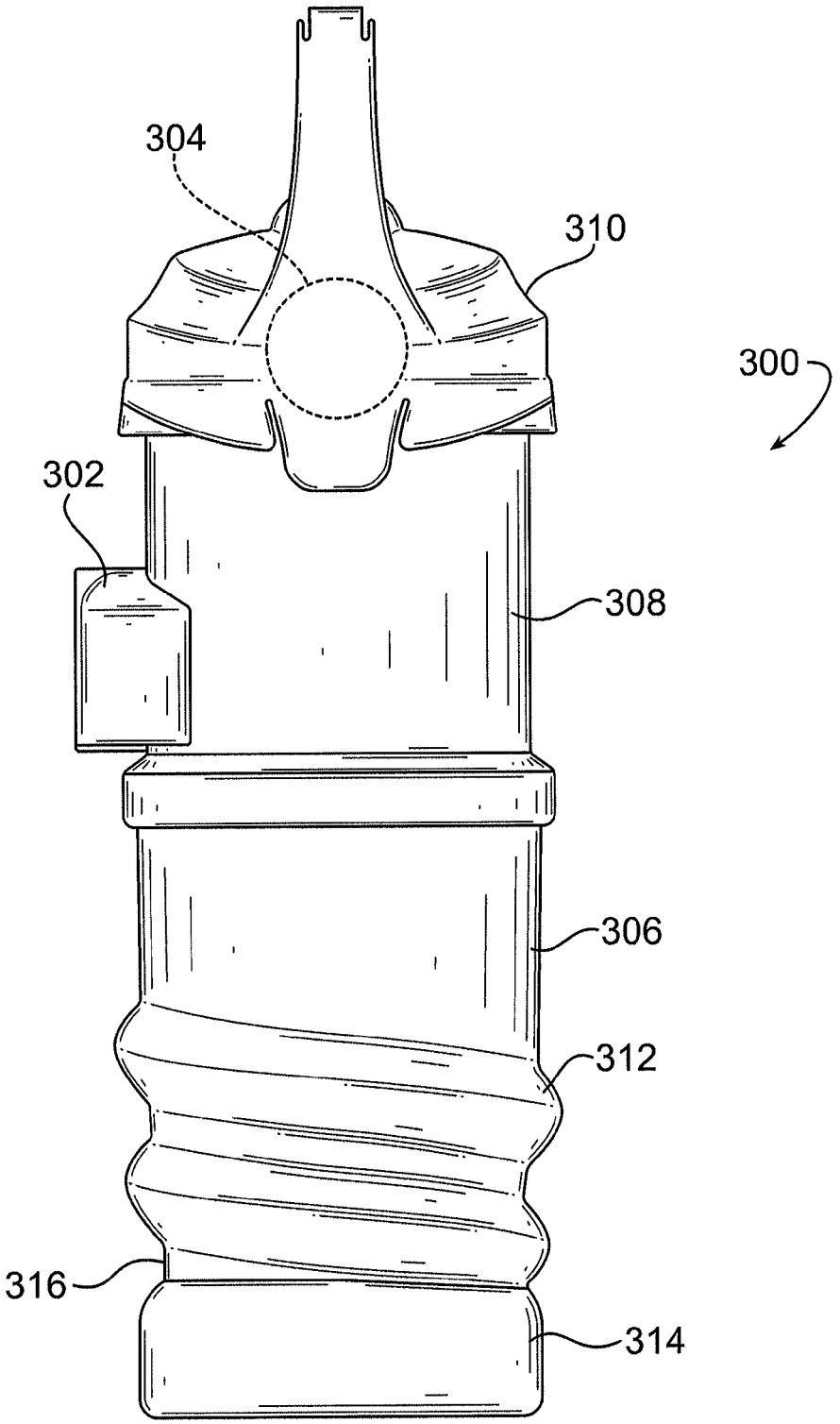
FIG. 3 is a front elevation view of a first exemplary embodiment.

The exemplary dirt collection assembly 300 includes a lower housing 306, an upper housing 308, and a lid 310. The air inlet 302 may be integrally formed with the upper housing 308, as shown in FIG. 3, or formed as part of the lower housing 306 or lid 310. The outlet 304 passes through the lid 310 in the shown embodiment, but it also may be at different locations. For example, the outlet 304 may be formed through the lower housing 306, such as through the bottom of the lower housing as shown in U.S. Pat. No. 7,922,794, which is incorporated herein by reference, or through the upper housing 308. It will also be appreciated that the lower housing 306, upper housing 308 and lid 310 may be formed as any suitable combination of integrally-formed or assembled parts, as known in the art.

The lower housing 306, upper housing 308 and lid 310 may be transparent, opaque, or a combination thereof, and may include fill markers and other such features, as known in the art. The lower housing 306, upper housing 308, lid 310, and other parts described herein may be constructed of any suitable material, such as plastic or metal.

The lower housing 306 may form part of a cyclone chamber, as described below, and also may form a dirt container 408 that receives dirt removed from the air passing from the inlet 302 to the outlet 304. Alternatively, a passage may be provided to eject separated dirt into a remote container (see, e.g., U.S. Pat. No. 6,502,277). The entire lower housing 306, or only portions thereof, may be removable from the upper housing 308 to clean the contents of the lower housing 306. For example, the bottom of the lower housing 306 may be formed as a pivoting or otherwise openable door, as known in the art, in which case it may be desirable to form the upper housing 308 and lower housing 306 as a single part. Alternatively, a lower portion of the lower housing 306 may be removable from the rest of the structure as a removable cup-like part, also as known in the art. Other variations on dirt containment arrangements and removable or openable dirt-release features will be apparent to persons of skill in the art in view of the present disclosure.

The lower housing 306 surrounds an inner shroud 404. The shroud 404 may be integrally formed with the lower housing 306, or provided as a separate removable part that is inserted into the lower housing 306. The exemplary shroud 404 includes an upper region 410, an intermediate region 412, and a lower region 414. In addition, a shroud extension 416 may extend from the lower region 414 towards or all the way to the bottom of the lower housing 306. If the shroud extension 416 is removable from the lower housing 306, or if the bottom of the lower housing 306 is a removable door, the shroud extension 416 may have a seal 418 that seals against the bottom of the lower housing 306 or the door.

The shroud 404 may be sealed to the upper housing 308 at the upper region 410 of the shroud 404 by any suitable seal (e.g., an elastic O-ring or lip seal, or simply surface-to-surface contact). Such seal may be provided directly between the upper housing 308 and the shroud 404, or through one or more intermediary members, such as by mutual sealed contact to the lid 310. The upper region 410 also may include a ramp 420 (best shown in FIG. 6) or other air-directing structures to influence the movement of the airflow within the space 406 between the lower housing 306 and the shroud 404.

The intermediate region 412 of the shroud 404 may have any shape suitable for accommodating a cyclonic flow of air exterior to the shroud 404. Cylindrical, frustroconical and other shapes may be used. The exemplary shown intermediate region 412 is frustroconical, and tapered to reduce in diameter towards the bottom of the dirt collection assembly 300. An "inverted" taper that gets smaller towards the top could alternatively be used. The wall also could be rounded or otherwise curved as viewed from the side; for example, the shroud may have an hourglass or spherical shape.

Air may pass through the shroud 404 to travel from the inlet 302 to the outlet 304. For example, the intermediate region 412 and/or the upper region 410 may comprise one or more openings 422 to permit air to pass from the inlet 302 to the outlet 304. The openings 422 may be formed as mesh screens, perforations (i.e., holes through the shroud surface), filtration surfaces, or the like. Any suitable variation on the location, size and construction of the openings 422 may be used, and numerous examples of such variations are known in the art. For example, the openings 422 may comprise four large openings covered by fine mesh screens, as illustrated in the exemplary embodiment, or a series of small (e.g., 1/16-inch) holes. Alternatively, the openings 422 may be provided by forming the intermediate region 412 as a pleated filter. For example, the shroud 404 itself may be a cylindrical or frustroconical pleated filter that is permanently or removably connected to an upper region that mounts to the lower housing 306.

One or more filters (e.g., foam filters, pleated filters, and the like) (not shown) may be provided within the shroud 404 and adjacent the openings 422. An example of such an arrangement is shown in U.S. Pat. No. 6,558,453, which is incorporated by reference herein.

It will be appreciated that in other embodiments, air passing from the inlet 302 to the outlet 304 may pass under the shroud 404, rather than through the intermediate region 412. For example, a gap may be provided between the shroud 404 and the shroud extension 416 to permit air to travel to the outlet 304.

The lower region 414 of the shroud 404 may include a separator plate 424 that extends radially with respect to a cyclone axis A (discussed below) from the shroud 404 towards the lower housing 306. The separator plate may be flat (i.e., perpendicular to the rotational axis of the cyclonic airflow), angled towards the bottom of the lower housing 306 (as shown), or angled away from the bottom of the lower housing 306. In any event, it will be understood that the separator plate 424 extends radially (i.e., flat), and may also extend axially (i.e., angled). The shown separator plate 424 is angled downward at an angle of about 20 degrees to about 50 degrees (the angle being measured relative to a line perpendicular to the cyclone axis A). The separator plate 424 also may include notches, perforations, depending skirts or fins, and the like, as known in the art. The separator plate 424 may form a solid barrier at the bottom of the shroud 404, or it may have one or more openings to accommodate a shroud extension 416 or an air passage (e.g., a gap between the shroud 404 and the shroud extension 416 as described above, or an outlet air passage extending to the bottom of the lower housing 306). In use, the separator plate 424 is expected to provide a barrier between upper and lower reaches of the enclosed volume, which may have a favorable influence on the air flowing therethrough. The separator plate 424 preferably does not extend so far as to contact the lower housing 306 or get so close that it entirely inhibits airflow between the plate 424 and the lower housing 306, but portions of the separator plate 424 may contact or nearly contact the lower housing 306 in alternative embodiments.

The exemplary shroud extension 416 extends from the lower region 414 of the shroud 404 to the bottom of the lower housing 306. The shroud extension 416 may be provided to form a storage space for dirt separated by a downstream cyclone, as a structure to help control the airflow within the lower part of the lower housing, as an air passage that leads to an air outlet through the bottom of the lower housing, or for other purposes as known in the art. Alternatively, the shroud extension 416 may be omitted (see FIG. 7). The shroud extension preferably has a smaller diameter than the lower region 414 of the shroud 404 and/or the separator plate 424.

Figure 5:
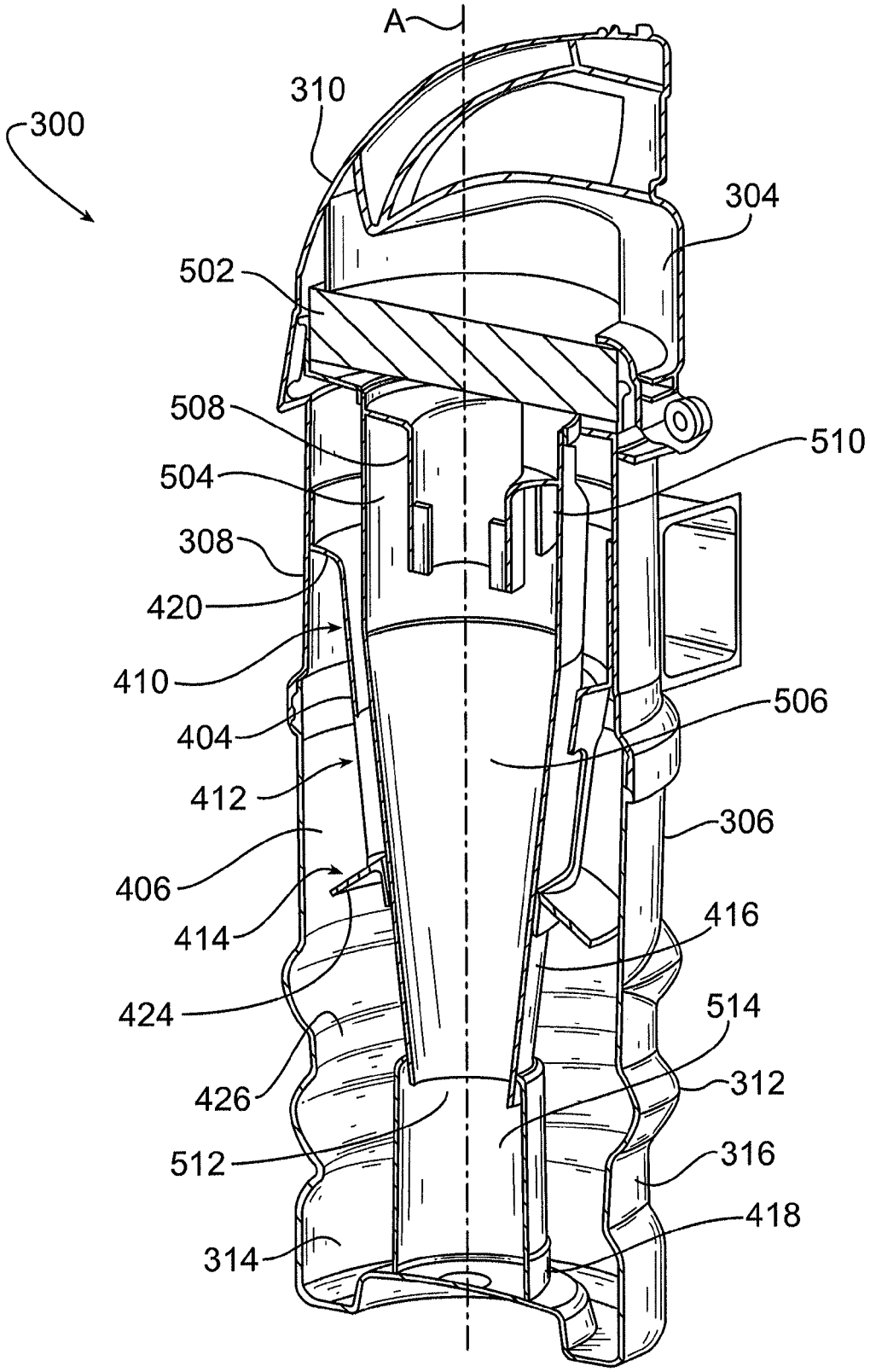
FIG. 5 is a partially cutaway right side elevation view of the embodiment of FIG. 3.
Figure 6:
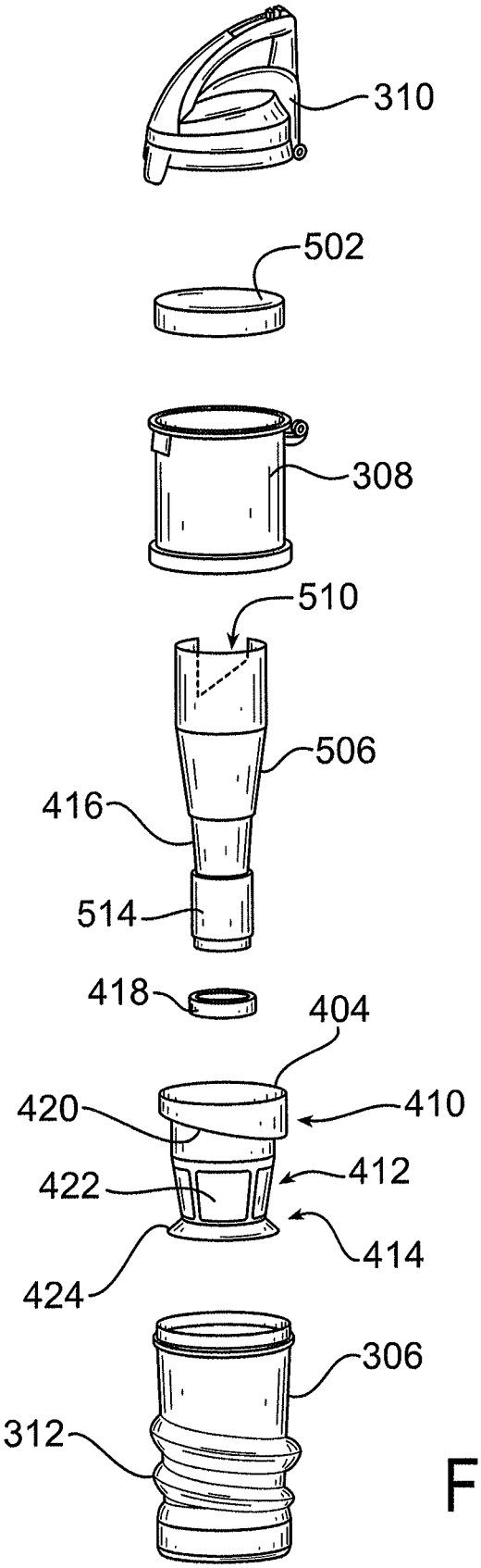
FIG. 6 is an exploded view of the embodiment of FIG. 3.

As shown in FIG. 5, the exemplary embodiment optionally includes one or more second-stage cyclones, such as a second-stage cyclone 504 located inside the shroud 404. The second stage cyclone 504 may be any suitable cyclone separator or plurality of separators. The exemplary second stage cyclone 504 has a conical wall 506, a cylindrical outlet tube 508, a tangential air inlet 510 adjacent the top of the cyclone 504, and a dirt outlet 512 at the bottom of the conical wall 506. In this exemplary embodiment, the shroud extension 416 comprises a portion of a conical wall 506 that forms part of the second-stage cyclone, as well as a dirt receptacle 514 located at the bottom of the conical wall 506.

Features of shrouds (e.g., seals, separator plates, and inner cyclones) that may be used with this and other embodiments, and exemplary alternative shrouds, are shown in U.S. Pat. Nos. 4,853,008; 5,078,761; 5,846,273; 6,146,434; 7,247,181 and 7,922,794, which are incorporated herein. Other variations (such as forming the upper and/or lower regions of the shroud integrally with the lower housing 306 or upper housing 308 also will be readily apparent in view of the teachings herein.

The parts of the dirt collection assembly 300 are configured to form a cyclone separator that removes dirt from the air passing through the dirt collection assembly 300. The cyclone separator comprises a cyclonic airflow region in which air passing from the dirty air inlet 302 to the clean air outlet 304 moves in a cyclonic fashion to remove dirt from the airstream. In the shown embodiment, the cyclonic airflow region is formed, at least in part, in the space 406 between the lower housing 306 and the shroud 404. The cyclonic airflow region also may extend to the space between the upper housing 308 and the upper region 410 of the shroud 404. The cyclonic airflow region also may extend below the shroud 404. The cyclonic airflow region comprises a mass of air that rotates generally around a cyclone axis A (FIG. 5). In the shown embodiment, the cyclone axis A extends generally along the central cylindrical axis of the lower housing 306 and shroud 404.

In general terms, the cyclonic airflow region is contained in the radial direction (that is, perpendicular to the cyclone axis A) between an outer cyclone chamber wall and an inner cyclone chamber wall. In the exemplary embodiment, the inner surface of the lower housing 306 forms at least a portion of an outer cyclone chamber wall, and the shroud 404 forms at least a portion of an inner cyclone chamber wall. The upper housing 308 (if provided) may form an additional portion of the outer cyclone chamber wall, and the shroud extension 416 (if provided) may form an additional portion of the inner cyclone chamber wall. The cyclonic airflow region is contained in the axial direction (that is, along the cyclone axis A) between an upper cyclone chamber wall and a lower cyclone chamber wall. Here, the upper cyclone chamber wall is formed by the upper region 410 of the shroud 404 (e.g., a ramp 420), and the lower cyclone chamber wall is formed as the bottom of the lower housing 306. Thus, the cyclonic airflow region is contained within a generally enclosed space that is fluidly connected to the air inlet 302 and air outlet 304. It will be appreciated that the boundaries of the enclosed space, such as the radial and axial boundaries described above, may be spaced from the cyclonic airflow region itself—for example, the cyclonic airflow region may not extend all the way to the bottom of the lower housing 306. It will also be appreciated that the exact shape and size of the cyclonic airflow region may fluctuate and vary depending the amount and nature of dirt captured within the lower housing 306 and the particular operating conditions (e.g., airflow restrictions upstream of the inlet 302, fan speed, etc.).

In the exemplary embodiment, the outer cyclone chamber wall is formed primarily by the generally vertically-extending sidewalls of the lower housing 306. The sidewalls may have a compound shape that includes cylindrical and/or tapered portions of different angles. The sidewalls may, except for the guide channel or channels described below, have a generally circular profile (the "profile" being the shape as viewed along the cyclone axis A), but oval, ovoid, and other profiles may be used. The lower housing 306 also may include ribs or other structures as previously described herein and known in the art.

As explained below, it is believed that conventional cyclones, particularly those having a separator plate, can have certain performance issues. In conventional cyclones, the outer cyclone wall typically has a continuous profile that doesn't change, or changes only slightly, between the top and the bottom of the cyclone chamber. For example, the outer cyclone wall may have a circular profile that remains circular (although it might reduce in diameter) throughout the vertical extent of the cyclone chamber. In such devices, the cyclonic air flow path begins at the air inlet and swirls around the chamber generally following the profile of the outer cyclone wall. The swirling air flows downward to a point below the separator plate, moves radially inwards towards the center of the lower housing, and rises back above the separator plate before finally exiting the cyclone through openings in the shroud. An example of this flow pattern (albeit without a separator plate) is shown in U.S. Pat. No. 7,922,794. In general terms, the cyclone comprises an outer portion that moves in a downward helix, and an inner portion that moves upward—oftentimes in an upward helix. There is no physical barrier between the downward and upward portions of the cyclone, so some intermingling or blending of airflow between these two parts of the cyclone is possible and likely. It is also likely that dirt and debris that might still be in the cyclonic airflow after it reverses direction and moves upward might be ejected into the outer, downward-moving portion of the flow, and vice-versa.

Figure 4:
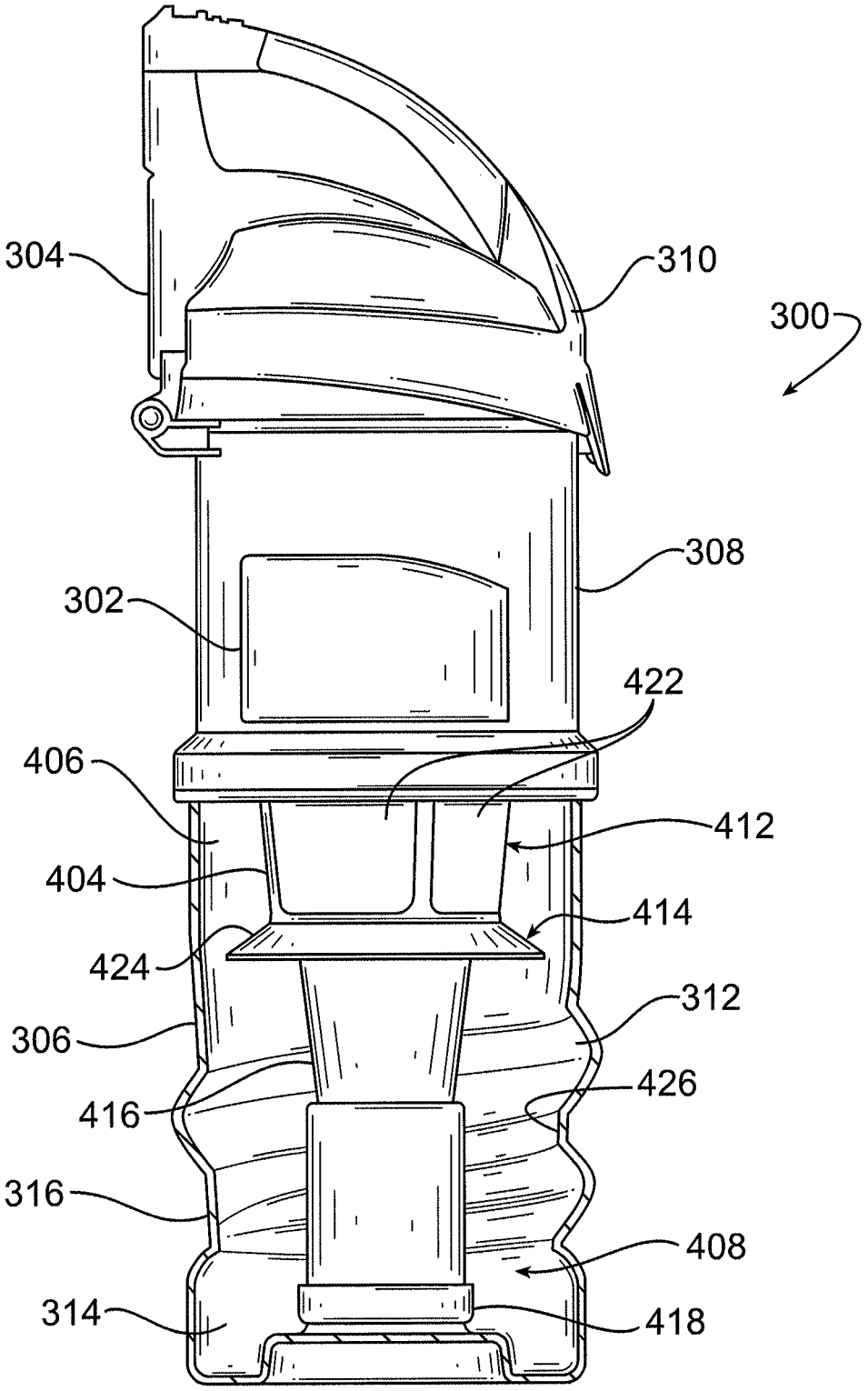
FIG. 4 is a partially cutaway left side elevation view of the embodiment of FIG. 3.

A separator plate 424, such as the one shown in FIG. 4, creates an obstacle around which the rising inner portion of the cyclone must travel to reach the shroud openings 422. By the time the airflow passes the separator plate 424, it may no longer move in a cyclonic manner (e.g., it might be moving straight up), or the nature of the motion might be altered by interaction with objects below the separator plate 424. In any event, the air passing back up and around the separator plate still must pass immediately adjacent the descending helical flow that forms the outer part of the cyclonic airflow. As the rising air passes the descending air, there is an opportunity for the airflows to mix, and for dirt and debris to transfer from one flow to the other. It is expected that this intermingling may reduce the efficiency of the cyclone. The effect of this intermingling may be more prevalent at and around the lower extent of the cyclonic airflow, where the upward and downward airflows might be moving at more similar speeds.

It is also believed that a separator plate 424 that is relatively large relative to the diameter of the lower housing 306 might cause a separate issue. Namely, a relatively narrow gap between the separator plate 424 and the lower housing 306 might reduce movement of the cyclonic airflow below the separator plate 424. This effect might be exacerbated as the volume of the lower housing fills with dirt. This also might reduce the efficiency of the cyclone.

The foregoing contemplated reductions in efficiency may occur during any one or more operational states. For example, a reduction might occur at startup when the cyclone is beginning to form, or during steady-state operation. A reduction might also occur as the dirt fills the lower housing, or upon the sudden introduction of large masses into the cyclone.

It is believed that performance of the cyclone separator may be enhanced (under any one or more operational states), by providing the lower housing 306 with an expanded region that preferably is formed as a helical guide channel 312 on the inner surface of the lower housing 306. The helical guide channel 312 extends radially outward (i.e., further from the cyclone axis A and the axis of the lower housing 306) from the adjacent portion of the lower housing 306. The guide channel 312 is formed on the inner surface of the lower housing 306, but a corresponding outward bulge may be provided on the outer surface of the lower housing 306 to maintain a generally constant wall thickness throughout the lower housing 306. As shown in FIGS. 3-5, the guide channel 312 preferably has a helical orientation that is the same as the outer portion of the cyclonic airflow. For example, if the outer, downward-moving helical airflow of the cyclone rotates counterclockwise as it descends through the lower housing 306, so too does the helical guide channel 312.

It is expected that the guide channel 312 will help enhance performance by providing a discrete region in which the cyclonic airflow, and particularly the outer portion of the cyclonic airflow, can expand in the radial direction. In doing so, the speed of the air is expected to reduce, which may help to release entrained dirt and debris. Furthermore, the guide channel 312, which preferably protrudes further from the cyclone axis A than the rest of the lower housing sidewall, may guide relatively large particles to the bottom of the lower housing 306 and slow them down. This is expected to help remove the larger particles from interaction with the smaller particles that may still be entrained in the airflow or that might be amassing closer to the cyclone axis A, and reduce the likelihood that the larger particles will become reentrained in the airflow. This benefit may be greater when a shroud extension 416 occupies the central region of the cyclone chamber, causing dirt to accumulate closer to the outer cyclone chamber wall formed by the lower housing 306. Still further, the guide channel 312 may provide an area in which the outer portion of the cyclone can move away from the rising inner portion of the cyclone. This added distance may help reduce the potential for deleterious intermingling of air or dirt between the descending outer portion of the cyclone, and the ascending inner portion of the cyclone. This effect may be particularly beneficial at the location of the separator plate 424 (if one is provided), where the inner and outer portions of the cyclone come into relatively close proximity, and near the bottom of the cyclonic airflow region, where the air in the inner and outer portions of the cyclone may be traveling at more similar speeds.

The guide channel 312 preferably is shaped, oriented and sized so that is simply reshapes the existing cyclonic airflow, without interfering with the overall and general configuration of the normal cyclonic airflow. To this end, the guide channel is oriented in the same helical direction as the adjacent airflow (such as described above), and may also be formed with relatively smooth contours and few or no sharp edges. For example, the inner surface of the exemplary illustrated guide channel 312 is formed as a rounded channel, such as shown in FIG. 4. It will be understood that such rounded profiles and the lack of sharp edges are not strictly required in all embodiments. The rounded channel may optionally be formed as a generally V-shaped groove having convex walls (that is, convex with respect to the inner volume of the lower chamber 306), as shown in the Figures. As also shown in the Figures, the upper wall may be shorter than the lower wall, or other size variations may be used. As shown in FIGS. 3-5, the guide channel 312 may be located on a tapered portion of the lower housing 306, but it may instead be on a cylindrical portion or other portions of the lower housing 306. The radial dimension of the guide channel 312 may exceed the largest radial dimension of the remaining parts of the lower housing 306, as shown, but in other embodiments, the lower housing 306 or upper housing 308 may have a larger radial dimension than the guide channel 312. For example, a relatively small-diameter lower housing 306 and guide channel 312 may be mounted below a larger-diameter upper housing 308.

The guide channel 312 may have any suitable height (dimension along the rotation axis of the cyclone) and depth (radial dimension with respect to the rotation axis of the cyclone). The guide channel also may have any suitable pitch (i.e., space between centerline of adjacent turns) and number of turns or fractional turns around the diameter of the lower housing 306. For example, the shown guide channel 312 has a height of about 1.378 inches (about 35 millimeters), a depth of about 0.374 inches (about 9.5 millimeters), a pitch of about 1.772 inches (about 45 millimeter) and extends about 2 turns around the lower housing 306. In the shown embodiment, the lower housing 306 has a diameter that varies from about 4.961 inches (about 126 millimeters) at the upper end of the guide channel 312 to about 4.567 inches (about 116 millimeters) at the lower end of the guide channel 312. The exemplary separator plate 424 is located adjacent the top of the guide channel 312, and has a diameter of about 4.134 inches (about 105 millimeters).

The guide channel 312 preferably wraps around the lower housing 306 at least once, and more preferably one and a half times or more, but it may wrap only partially around the lower housing 306. If desired, multiple guide channels 312 may be provided, either at separate locations (e.g. one above the separator plate 424 and another separate channel below the separator plate 424), or interspaced to wind together across adjacent portions of the lower housing 306 (e.g., as in the fashion of a double-lead screw). In the shown embodiment, the guide channel 312 extends continuously as an uninterrupted channel, but it may be broken into separate parts by periodic gaps. Also, in the shown embodiment, the pitch and height are selected such that adjacent turns of the guide channel 312 are spaced from one another by a gap 426, but this also is not required in all embodiments. For example, an alternative guide channel 312 may overlap or touch at portions that are adjacent one another, or the guide channel 312 may have a changing pitch that has a gap 426 that eventually disappears as the pitch angle decreases.

The guide channel 312 may be located at any vertical location within the lower housing 306. In the illustrated embodiment, the guide channel 312 begins at approximately the level of the separator plate 424, and extends partially or all the way to the bottom of the lower housing 306. In the shown embodiment, the guide channel 312 extends downward the full distance of the lower housing 306 to a rest cylinder 314 located at the bottom of the lower housing 306. The rest cylinder 314 has a larger diameter than the immediately adjacent lower housing wall 316, and provides an area for larger debris to settle and is expected not to significantly affecting the upwards airflow or the particles entrained therein. The final portion of the guide channel 312 (e.g., the final 30% or less) optionally may merge into the rest cylinder 314, thereby providing a continuous expanded channel region to convey the larger particles all the way to the rest cylinder 314.

Figure 7:
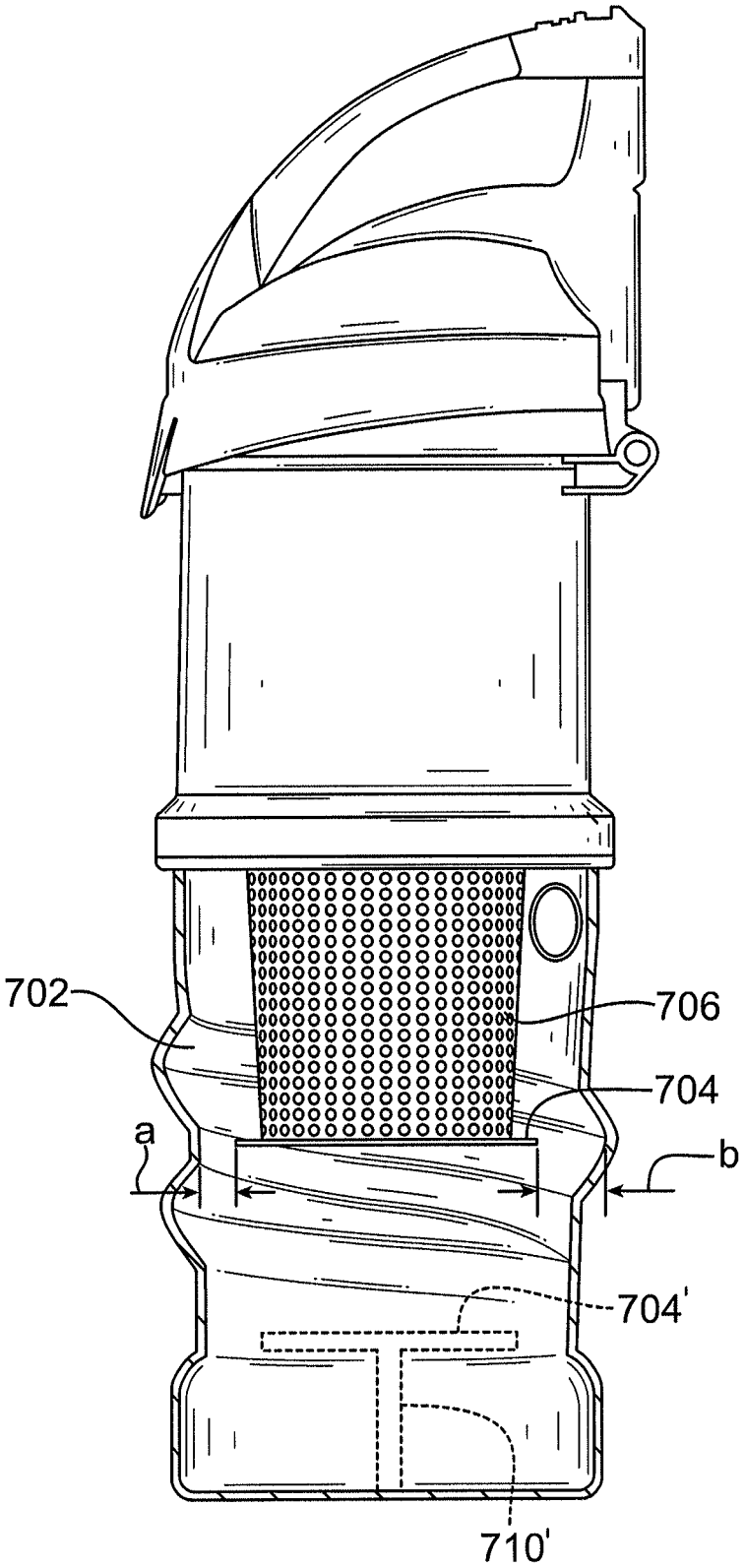
FIG. 7 is a partially cutaway front elevation view of another exemplary embodiment.

In an alternative embodiment, shown in FIG. 7, at least a portion of the guide channel 702 extends above a separator plate 704 provided on the bottom of a perforated shroud 706. This arrangement increases the size of at least part of the gap between the separator plate 704 and the immediately adjacent sidewall of the lower housing 708, as shown by measurements "a" and "b", and may provide a benefit such as by reducing flow intermingling at that location.

In other embodiments, the guide channel may be entirely above a separator plate. For example, the separator plate 704 in FIG. 7 may be removed from the shroud 706, and replaced with a separator plate 704' on a post 710' that holds the separator plate 704' just below the bottom of the guide channel 702.

It is also expected that the benefits of a guide channel 312 may also be realized even if no separator plate is provided on the shroud or if the shroud includes a cylindrically depending wall (see, e.g., U.S. Pat. No. 7,922,794). In such cases, it is expected that the guide channel 312 may provide a relieved region to form a larger space between the inner and outer cyclone portions, provide a channel where larger particles can decelerate and convey to the bottom of the lower housing 306, and help reduce dirt re-entrainment at the bottom portion of the cyclonic airflow region.

Still another possible benefit of the guide channel 312 is to provide a flow-influencing feature that helps maintain the cyclonic airflow in the lower housing 306 in its original cyclonic pattern even after dirt and debris begin to accumulate in the lower housing 306. This attribute may be enhanced by providing a relatively deep channel, or by forming the edges of the channel with lips that extend towards the center of the lower housing. As another example, the gap 426 between adjacent turns of the guide channel 312 may protrude radially inward, instead of being along a continuous path with the remaining non-channel portions of the lower housing 306 as shown in the illustrated embodiment.

Mathematical flow modeling has suggested that a cyclone having a helical guide channel 312, such as the exemplary embodiment illustrated in the Figures, would have favorable performance characteristics. It will be readily appreciated by those of ordinary skill in the art that the efficacy of this and other embodiments can be further investigated, without undue experimentation, using further mathematical flow modeling and through the use of rapid prototyping, bench testing, and simulated or actual real-world application of contemplated designs. While a number of theories of operation and benefits are described herein, the invention is not intended to be limited to any particular theory of operation or benefit, and other operation modes and uses of embodiments of the invention are intended to be covered by the claims.

Figure 8:
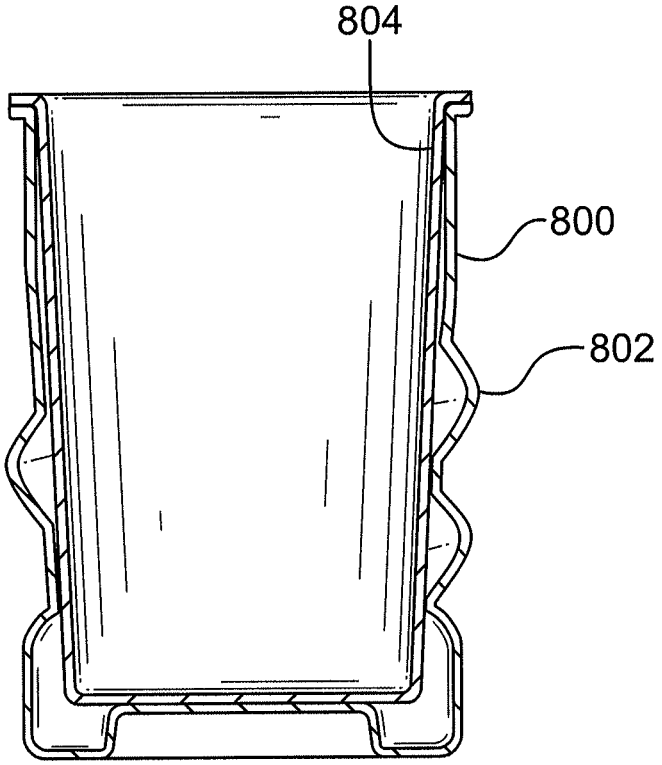
FIG. 8 is an exemplary insert for a cyclone chamber.

Referring to FIG. 8, it may be desirable under some circumstances to revert the cyclone cup design to a conventional configuration in which the inner wall of the cyclone is a continuous cylindrical or frustroconical shape lacking a guide channel 312. For example, it may be determined that some types of dirt or debris are better separated using a conventional cyclone shape, and an insert may be provided (either permanently or as a user-removable component) to convert the cyclone to a conventional shape. An exemplary embodiment of a conversion feature of the foregoing variety is shown in FIG. 8. Here, a cyclone cup 800 having a guide channel 802 may be modified by adding an inner sleeve 804 lacking a guide channel. The resulting structure would operate as a conventional cyclone. The insert 804 may be permanently or removably installed, may be opaque or transparent, and may include other features (e.g., flow-influencing vanes or ribs) as desired for the particular application.

Another benefit of the construction of FIG. 8 is that it may help insulate sound generate in and around the cyclone chamber. The embodiment of FIG. 8 is a dual-wall cup structure. The two walls provide an additional layer of material to absorb sounds. In addition, the air space formed by the gap between the guide channel 312 and sleeve 804 may further reduce sound transmission.

Furthermore, it is expected that the guide channel 312 may provide an additional sound-reducing benefit even if it is used without an inner sleeve 804. This benefit may arise because the guide channel 312 interrupts the regular cylindrical or frustroconical profile and thereby reduces the likelihood that the structure will be susceptible to resonant-frequency noise transmission. The irregular shape of a cup with a guide channel 312 also may resist the formation of standing waves, and be more rigid, which also may help reduce sound levels outside the vacuum cleaner. Other modes of noise reduction may arise as a result of using a guide channel 312 in a single-wall or dual-wall construction, and the invention is not intended to be limited to any particular theory of operation.

It will be appreciated that a lower housing 306 with a guide channel 312 can be formed using any suitable manufacturing method. Conventional plastic injection molding is often used to make vacuum cleaner cyclone parts, because this process is relatively inexpensive and suitable for producing durable, transparent parts. Normally, injection molding is suitable for non-convoluted parts that can be released from a simple two-piece mold. For structures with convolutions (i.e., features that would prevent the removal of a simple two-part mold), more complex injecting molding processes and equipment may have to be used. The lower housing 306 shown in FIGS. 3-6 is convoluted due to the presence of a helical guide channel that overlaps itself, and this part could not be made using a conventional two-piece injection molding process (if the guide channel extended only partially around the circumference of the housing, it may be possible to make the housing a single 2-part injection molding process). The lower housing 306 may, however, be injection molded using joining two or more separately molded parts, such as by forming the housing as separate lateral halves divided along the cyclone axis A that are joined together to form the final shape. It also might be possible to make the shown structure, or something akin to it, using complex multipart molds with movable inserts. In addition to adding cost, such multi-step and complex molding processes may not result in precise junctions between the parts, which could further add to costs by requiring more processing, increase the cost of maintaining and operating the molds, and might affect the cyclonic airflow within the lower housing.

To overcome the deficiencies of normal production methods, the lower housing 306 may be formed using blowmolding. In blowmolding processes, pressurized gas is used to press plastic material against the inner wall of a separable or disposable mold. Using this process, the lower housing 306 may be provided as a predecessor part formed as a simple cylindrical or tapered cup, which is heated and enclosed in a mold. The inner surface of the mold is shaped as the final lower housing exterior surface shape, including the guide channel. Pressurized gas is forced into the cup-like shape, causing it to deform and expand to press against the inner wall of the mold. After suitable cooling, the mold is split and the lower housing, with the guide channel formed in it, is released. In addition saving processing costs and eliminating seams, a lower housing formed in this or a similar blowmolding process may require less material and be lighter than an injection-molded counterpart.

Another option is rotational molding (a.k.a. spincasting), which uses movement and gravity to distribute the molten plastic against the inner wall of a separable or disposable mold. Using either blowmolding or rotational molding, the resulting part may be essentially free of internal seams that could interfere with airflow within the lower housing, and little or no additional processing may be required other than trimming excess material.

It should be noted that terms such as "upper" and "lower" are used herein to assist with describing the illustrated embodiments and to indicate relative position within the frame of reference of the embodiment itself. The frame of reference of the embodiment is arbitrary in relation to the gravitational reference frame, and these terms of relative position are not intended to limit the invention to positions in the gravitational reference frame. For example, a part described as an "upper" part, may be at the same level or below a "lower" part as examined in the gravitational reference frame. Indeed, it is well-known that cyclone separators and other vacuum cleaner features can be operated in any physical orientation (often continuously moving between orientations, as in upright handle-mounted cyclones), with the rapid air movement within the cyclone chamber typically overcoming the relatively small gravitational influence on the dirt particles.

The present disclosure describes a number of new, useful and nonobvious features and/or combinations of features that may be used alone or together. The embodiments described herein are all exemplary, and are not intended to limit the scope of the inventions. It will be appreciated that the inventions described herein can be modified and adapted in various and equivalent ways, and all such modifications and adaptations are intended to be included in the scope of this disclosure and the appended claims.

The invention claimed is:

1. A vacuum cleaner dirt collection assembly comprising:
a housing;
an air inlet connected to the housing;
an air outlet connected to the housing;
a cyclone chamber inside the housing and fluidly connected between the air inlet and the air outlet, the cyclone chamber comprising:
a top wall,
a bottom wall,
an outer wall extending between and joining the top wall and bottom wall to form a generally enclosed space having a central axis extending from the top wall to the bottom wall, the outer wall further comprising a helical guide channel extending radially outward from an outer surface of the outer wall with respect to the axial centerline;
an inner wall located inside the generally enclosed space, the inner wall having a generally cylindrical or frustroconical surface having one or more openings fluidly connecting the enclosed space to the air outlet;
a separator plate located inside the generally enclosed space at a location along the central axis between the top wall and the bottom wall, the separator plate extending towards the outer wall and spaced from the outer wall by a gap.

2. The vacuum cleaner dirt collection assembly of claim 1, wherein the helical guide channel has an upper end closest to the top wall, and a lower end closest to the bottom wall, and the upper end is located adjacent the separator plate.

3. The vacuum cleaner dirt collection assembly of claim 1, wherein the helical guide channel has an upper end closest to the top wall, and a lower end closest to the bottom wall, and the upper end is located between the separator plate and the bottom wall.

4. The vacuum cleaner dirt collection assembly of claim 1, wherein the helical guide channel has an upper end closest to the top wall, and a lower end closest to the bottom wall, and the separator plate is located between the upper end and the lower end.

5. The vacuum cleaner dirt collection assembly of claim 1, wherein the helical guide channel has an upper end closest to the top wall, and a lower end closest to the bottom wall, and the bottom end is located between the separator plate and the top wall.

6. The vacuum cleaner dirt collection assembly of claim 1, wherein the helical guide channel has an upper end closest to the top wall, and a lower end closest to the bottom wall, and the bottom end extends to the bottom wall.

7. The vacuum cleaner dirt collection assembly of claim 1, wherein the separator plate is flat or angled towards the bottom wall.

8. The vacuum cleaner dirt collection assembly of claim 1, wherein the separator plate is connected to the inner wall at a location between the one or more openings and the bottom wall.

9. The vacuum cleaner dirt collection assembly of claim 1, wherein the housing comprises an upper housing and a lower housing removably connected to the upper housing, and wherein the helical guide channel is located on the lower housing.

10. The vacuum cleaner dirt collection assembly of claim 9, wherein the lower housing comprises as a single continuous blowmolded part.

11. The vacuum cleaner dirt collection assembly of claim 1, wherein the inner wall comprises:
a shroud having:
an intermediate region through which the one or more openings pass, the intermediate region extending a portion of the distance from the top wall towards the bottom wall, and
a lower region located at the end of the intermediate region distal from the top wall; and
a shroud extension that extends from the lower region of the shroud to the bottom wall.

12. The vacuum cleaner dirt collection assembly of claim 11, wherein the shroud extension comprises a portion of a second-stage cyclone system fluidly connected between the one or more openings and the air outlet.

13. The vacuum cleaner dirt collection assembly of claim 11, wherein the separator plate is connected to the lower region of the shroud.

14. The vacuum cleaner dirt collection assembly of claim 1, wherein the inner wall comprises:
an upper region connected to the outer wall and forming the top wall of the cyclone chamber;
an intermediate region extending from the upper region towards the bottom wall, the one or more openings being provided through the intermediate region; and
a lower region located at an end of the intermediate region distal from the upper region;
wherein the inner wall is separable from the outer wall and bottom wall.

15. The vacuum cleaner dirt collection assembly of claim 1, wherein the helical guide channel is oriented in a helical direction corresponding to the helical direction of an adjacent cyclonic airflow region created when air passes from the air inlet to the air outlet.

16. The vacuum cleaner dirt collection assembly of claim 1, wherein the helical guide channel wraps around the outer wall at least one time.

17. The vacuum cleaner dirt collection assembly of claim 1, wherein the helical guide channel wraps around the outer wall at least one and a half times.

18. The vacuum cleaner dirt collection assembly of claim 1, wherein the helical guide channel comprises a rounded channel.

19. The vacuum cleaner dirt collection assembly of claim 1, wherein the helical guide channel comprises a rounded channel formed by upper and lower walls arranged in a generally V-shape, the upper and lower walls being convex with respect to the enclosed space.

* * * * *